US006277057B1

(12) United States Patent
Hayden

(10) Patent No.: US 6,277,057 B1
(45) Date of Patent: Aug. 21, 2001

(54) ANKLE REHABILITATION DEVICE

(76) Inventor: Craig Hayden, 6371 S. Pine Valley La., Kearns, UT (US) 84118

( * ) Notice: Subject to any disclaimer, the term of this patent is extended or adjusted under 35 U.S.C. 154(b) by 0 days.

(21) Appl. No.: 09/514,784

(22) Filed: Feb. 28, 2000

(51) Int. Cl.[7] ..... A63B 21/00
(52) U.S. Cl. ..... 482/79; 601/32; 482/80
(58) Field of Search ..... 482/79, 80, 111–113, 482/121–130; 601/32, 31, 33

(56) References Cited

U.S. PATENT DOCUMENTS

| | | | | |
|---|---|---|---|---|
| 1,509,793 | * | 9/1924 | Thompson | 482/132 |
| 4,186,920 | | 2/1980 | Fiore et al. . | |
| 4,199,137 | | 4/1980 | Giguére . | |
| 4,310,155 | | 1/1982 | White . | |
| 4,337,939 | | 7/1982 | Hoyle et al. . | |
| 4,452,447 | | 6/1984 | Lepley et al. . | |
| 4,605,220 | | 8/1986 | Troxel . | |
| 4,739,986 | * | 4/1988 | Kucharik | 482/132 |
| 4,862,875 | | 9/1989 | Heaton . | |
| 5,203,321 | | 4/1993 | Donovan et al. . | |
| 5,215,508 | | 6/1993 | Bastow . | |
| 5,352,185 | | 10/1994 | Blauth et al. . | |
| 5,368,536 | | 11/1994 | Stodgell . | |
| 5,583,407 | * | 12/1996 | Yamaguchi | 482/132 |
| 5,722,919 | | 3/1998 | Timmer . | |

* cited by examiner

*Primary Examiner*—Jerome Donnelly
(74) *Attorney, Agent, or Firm*—Thorpe North & Western

(57) ABSTRACT

An ankle rehabilitation device includes a foot platform movably disposed on a support arm coupled to and extending upwardly from a base. The foot platform is configured to pivot along a restricted pivot path configured to limit the user's ankle movement to plantar flexion, inversion and internal rotation in one direction along the restricted pivot path, and dorsi flexion, eversion and external rotation in an opposite direction along the restricted pivot path. A ball and socket type joint is coupled between the foot platform and the support arm, and has an aperture sized and shaped to limit movement of a coupling arm, and thus to limit movement of the foot platform. The device also includes resistance means, such as piston/cylinders, coupled to and between the base and the foot platform, for resisting movement of the foot platform with respect to the base. The piston/cylinder may be oriented transverse to all pivot axes of the foot platform to resist all movement of the foot platform. In addition, the piston/cylinder may have a first end coupled to the front end of the base, and a second end coupled to the rear end of the foot platform, to save space.

28 Claims, 7 Drawing Sheets

ANKLE REHABILITATION DEVICE

BACKGROUND OF THE INVENTION

1. The Field of the Invention

The present invention relates generally to a device for ankle rehabilitation or exercise.

2. The Background Art

The most common type of ankle injury is a sprain. A sprain is stretching and tearing of ligaments (fibrous bands connecting adjacent bones in a joint). Sprains may occur in any ligament in the ankle, but most sprains involve the lateral ligament complex, or the group of ligaments on the outside of the ankle. The ligaments are named for their location and the bones to which they are attached. The anterior talofibular ligament is on the front side. The posterior talofibular ligament is on the back side. And the calcaneofibular ligament is on the middle side. The most frequent sprain occurs when weight is applied to a foot which is on an uneven surface, and the foot rolls in. When the sole of the foot is pointing inward as force is applied, the ligaments stabilizing the lateral, or outside, part of the ankle are stressed. Thus, the sprains are caused by forced inversion and flexion movements of the ankle.

Ankle sprains are graded as 1, 2 or 3 depending on the extent of the injury. A grade 1 sprain is very mild and involves stretching of the ligaments, or small partial tears of the anterior talofibular ligament. A grade 2 sprain is a complete tear of the anterior talofibular ligament and the calcaneofibular ligament, but only mild stress to the posterior talofibular ligament. A grade 3 sprain involves a complete rupture of all the ligaments of the lateral complex. Complete restoration of muscle strength requires physical therapy and rehabilitation to avoid subsequent sprains. Residual weakness is common after any ankle sprain. Ankle stability may be improved over the long term by stretching and other exercises to strengthen leg and ankle muscles.

The ankle is a complex joint that is capable of moving in multiple planes. These multiple planes include: dorsi flexion, or bending the foot upwards; plantar flexion, or bending the foot downwards; inversion, or turning the foot so that the sole faces inward; eversion, or turning the foot so that the sole faces outward; internal rotation, or rotating the foot inwardly about an axis concentric with the lower leg; and external rotation, or rotating the foot outwardly about the axis. During rehabilitation it may be necessary to focus on a single, simple movement in an individual plane. Other exercises may require movement in multiple planes. For example, exercising the posterior tibialis muscle requires simultaneous movement in multiple planes, including plantar flexion, inversion and internal rotation.

Numerous devices have been developed to assist in exercising and rehabilitating ankle injuries. Many of these devices are overly simple, and fail to provide the necessary range of motion, or limit undesired motion to adequately support the ankle. For example, U.S. Pat. No. 5,722,919 discloses a weighted shoe-like device. Because the device relies on weight or gravity, the user must manipulate his/her body to properly orient the weight for the desired exercise. As another example, U.S. Pat. No. 4,337,939 has a foot platform pivotally coupled to a base. Because the device has a single pivot axis, motion is limited to a single plane.

Other devices are overly complex, bulky and expensive, and still fail to limit undesired motion or adequately support the ankle. For example, U.S. Pat. No. 4,452,447 discloses a foot platform coupled to a base through a gimble. Although the device allows movement in all planes, such movement is not limited to prevent re-injury. U.S. Pat. No. 4,605,220 discloses a foot platform coupled to a base through a universal joint and four shock absorbers. The device only allows movement in two planes and the foot platform cannot pivot. U.S. Pat. Nos. 4,186,920 and 5,368,536 disclose foot platforms coupled to a base through a ball joint. Again, although movement in all the planes is allowed, such movement is not limited.

Therefore, it would be advantageous to develop an ankle rehabilitation or exercise device capable of allowing proper movement of a user's ankle while avoiding re-injury. It would also be advantageous to develop such a device capable of resisting movement of the user's ankle in multiple planes of movement, but which is compact, portable, simple, and inexpensive. It would also be advantageous to develop such a device which limits or restricts movement of the user's ankle to a desired movement path.

OBJECTS AND SUMMARY OF THE INVENTION

It is therefore an object of the present invention to provide an ankle rehabilitation or exercise device for providing a desired range of motion, and resistance, to a user's ankle.

It is another object of the present invention to provide such a device which is compact, portable, simple, and inexpensive.

It is yet another object of the present invention to provide such a device which limits, or restricts movement, of the user's ankle to a desired movement path.

The above objects and others not specifically recited are realized in a specific illustrative embodiment of an ankle rehabilitation device. The device includes a base; a support arm, coupled to and extending upwardly from the base; foot platform, pivotally disposed on the support arm; and resistance means, coupled to and between the base and the foot platform.

The foot platform advantageously is pivotal along a restricted pivot path configured to limit the user's ankle movement to plantar flexion, inversion and internal rotation in one direction along the restricted pivot path, and dorsi flexion, eversion and external rotation in an opposite direction along the restricted pivot path. The foot platform pivots along the restricted pivot path between (i) an extended position in which the foot platform is pivoted down and inwardly, and (ii) a retracted position in which the foot platform is pivoted up and outwardly.

The device advantageously may further include a ball and socket type joint, coupled to and between the foot platform and the support arm, to movably couple the foot platform to the support arm. A ball is movably disposed in a socket, which has an aperture. A coupling arm is attached to the ball and extends through the aperture in the socket. Thus, the coupling arm is movable in the aperture as the foot platform moves with respect to the base.

The aperture advantageously is sized and shaped to limit movement of the coupling arm, and thus to limit movement of the foot platform. The aperture may have a non-circular shape, and an aperture edge which limits movement of the coupling arm. The aperture may have a first concave indentation located towards a side of the foot platform corresponding to an extended position of the foot platform. In addition, the aperture may have a second concave indentation located towards a rear of the foot platform corresponding to a retracted position of the foot platform.

The resistance means may be at least one piston/cylinder, coupled to and extending between the base and the foot platform. The piston/cylinder advantageously is oriented transverse to all pivot axes of the foot platform to resist all movement of the foot platform. The at least one piston/cylinder is coupled to both the foot platform and base by ball and socket type joints to allow the piston/cylinder to pivot with respect to both the foot platform and base as the foot platform moves. In addition, the at least one piston/cylinder may have a first end coupled to the front end of the base and a second end coupled to the rear end of the foot platform to save space.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION

Figure 1:
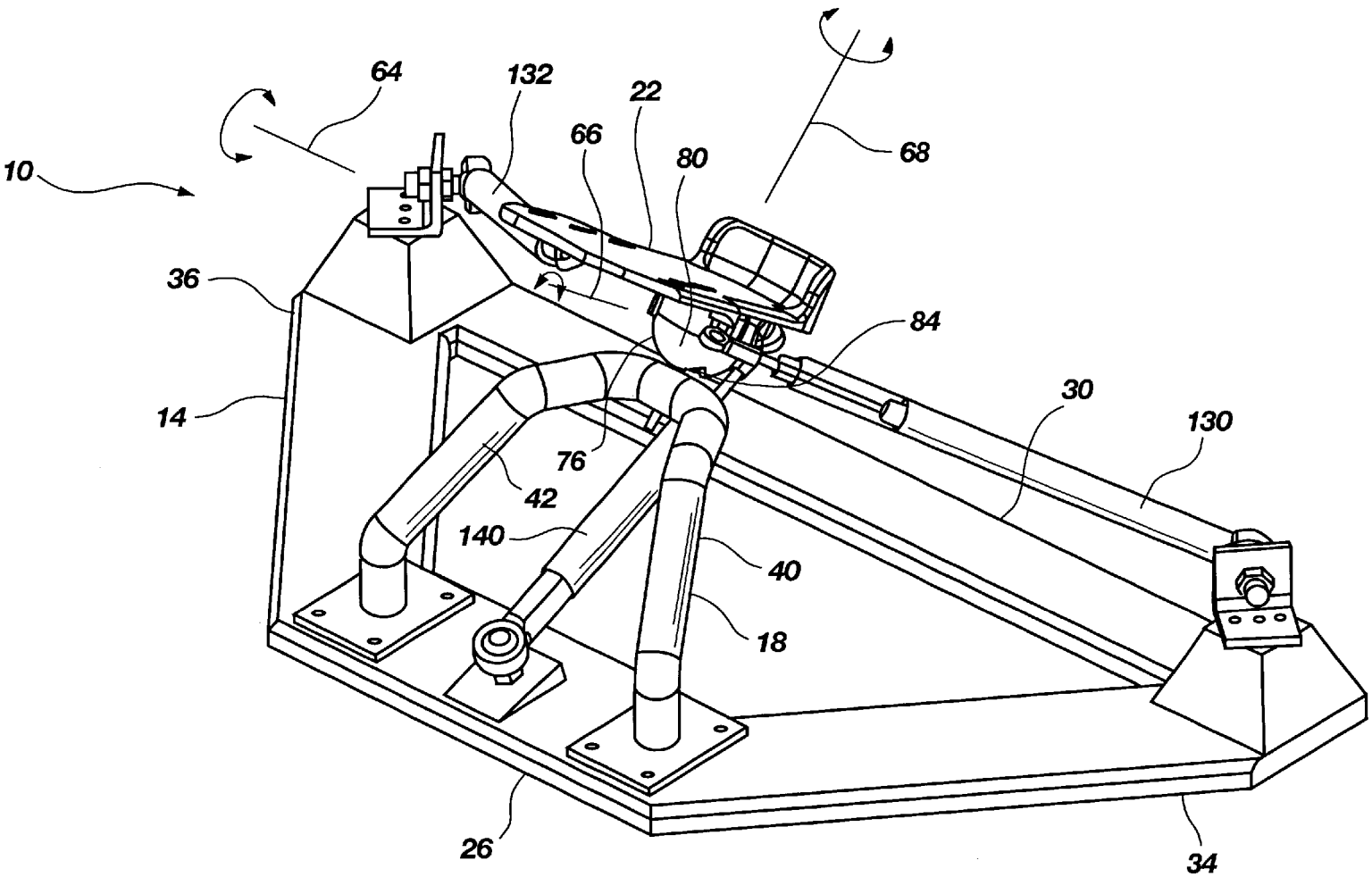
FIG. 1 is a perspective view of a preferred embodiment of an ankle rehabilitation device in accordance with the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

As illustrated in FIG. 1, an ankle rehabilitation or exercise device, indicated generally at 10, in accordance with the present invention is shown. The device 10 may be used in rehabilitation and physical therapy for ankle injuries, including for example, ankle sprains.

The device 10 includes a base 14; a support arm 18, coupled to and extending upwardly from the base 14; and a foot platform 22, pivotally coupled to the support arm 18. The base 14 is disposed on a support surface, such as a floor, or the ground. The base 14 preferably is rigid, and may be formed of metal or plastic. In addition, the base 14 preferably is as small as possible, or has a footprint as small as possible, to facilitate mobility or portability of the device 10. Thus, the base 14 has a length L and a width W which are small so that the device 10 is relatively short and narrow. The base 14 has a front, or forward end 26, a back or rearward end 30, and left and right sides 34 and 36. The base 14 may be flat, and may include perimeter segments surrounding an open interior to reduce weight.

As indicated above, the support arm 18 extends upwardly from the base 14. Preferably, the support arm 18 has an inverted U-shape, inverted V-shape, or wishbone configuration, including left and right arm portions 40 and 42. The arm portions 40 and 42 have spaced-apart, lower ends coupled to the base 14 to leave the center or middle of the front 26 of the base 14 open, as discussed in greater detail below. The arm portions 40 and 42 also have upper ends which extend towards one another, and which are coupled together. In addition to extending upwardly from the base 14, the support arm 18, or arm portions 40 and 42, also extend from the front 26 rearwardly at an angle towards the back 30 of the base 14 so that the upper ends of the arm 18, or arm portions 40 and 42, are disposed substantially over the center or middle of the base 14. Thus, the lower ends of the arm portions 40 and 42 are disposed at the front 26 of the base 14, while the upper ends are disposed more over the center of the base 14.

Also as indicated above, the foot platform 22 is pivotally coupled to the support arm 18, or upper ends of the arm portions 40 and 42. The foot platform 22 has an upper surface sized and shaped to receive a user's foot thereon. The foot platform 22 includes holes or apertures 46 to receive straps (not shown) to secure the user's foot to the foot platform 22. In addition, the foot platform has a front or forward end 50, a back or rearward end 52, and left and right sides 54 and 56. A heel support 60 may be formed on the back 52 of the foot platform 22, extending outwardly therefrom, to support the user's heel.

Figure 2:
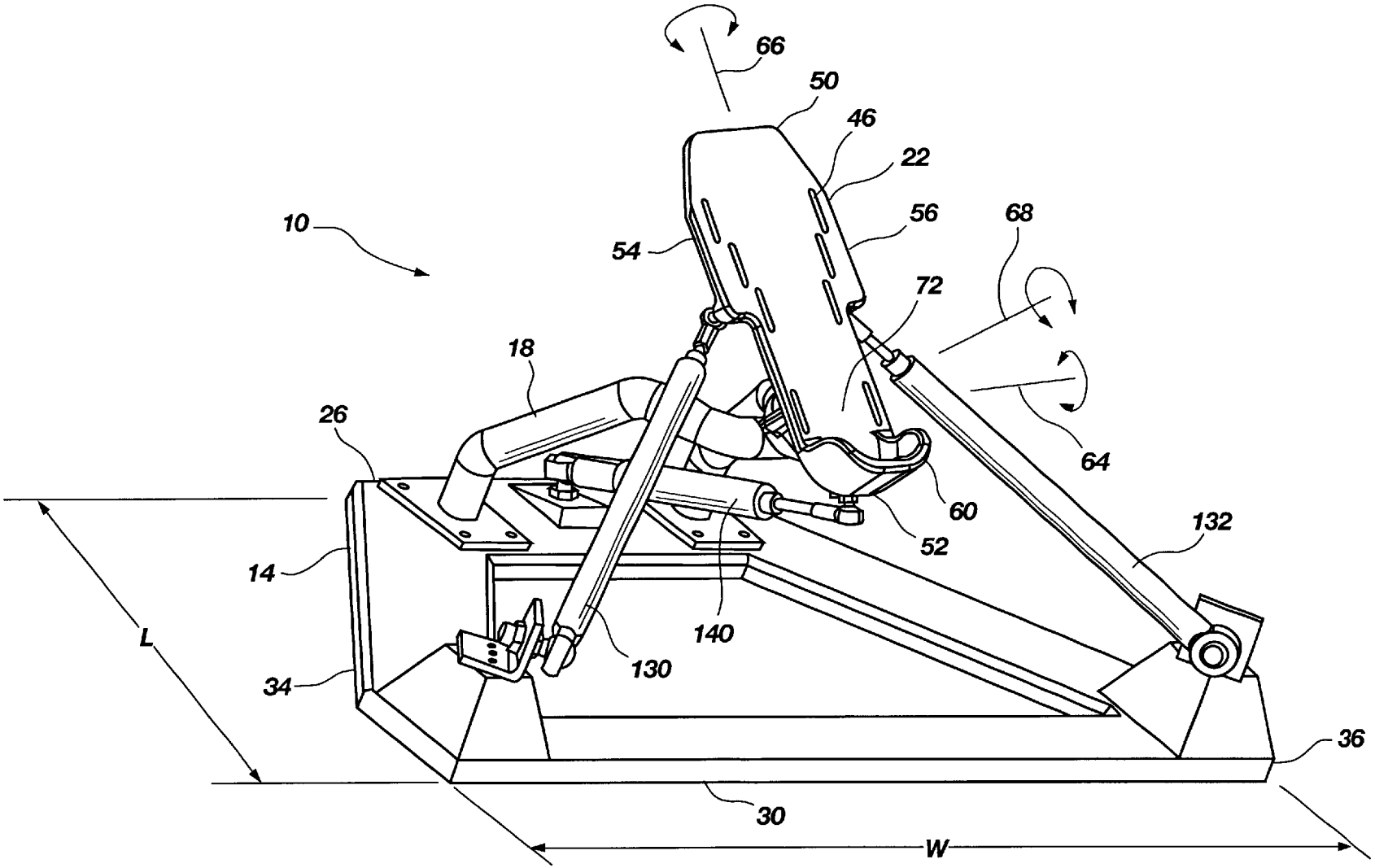
FIG. 2 is another perspective view of the preferred embodiment of the ankle rehabilitation device of the present invention.
Figure 3:
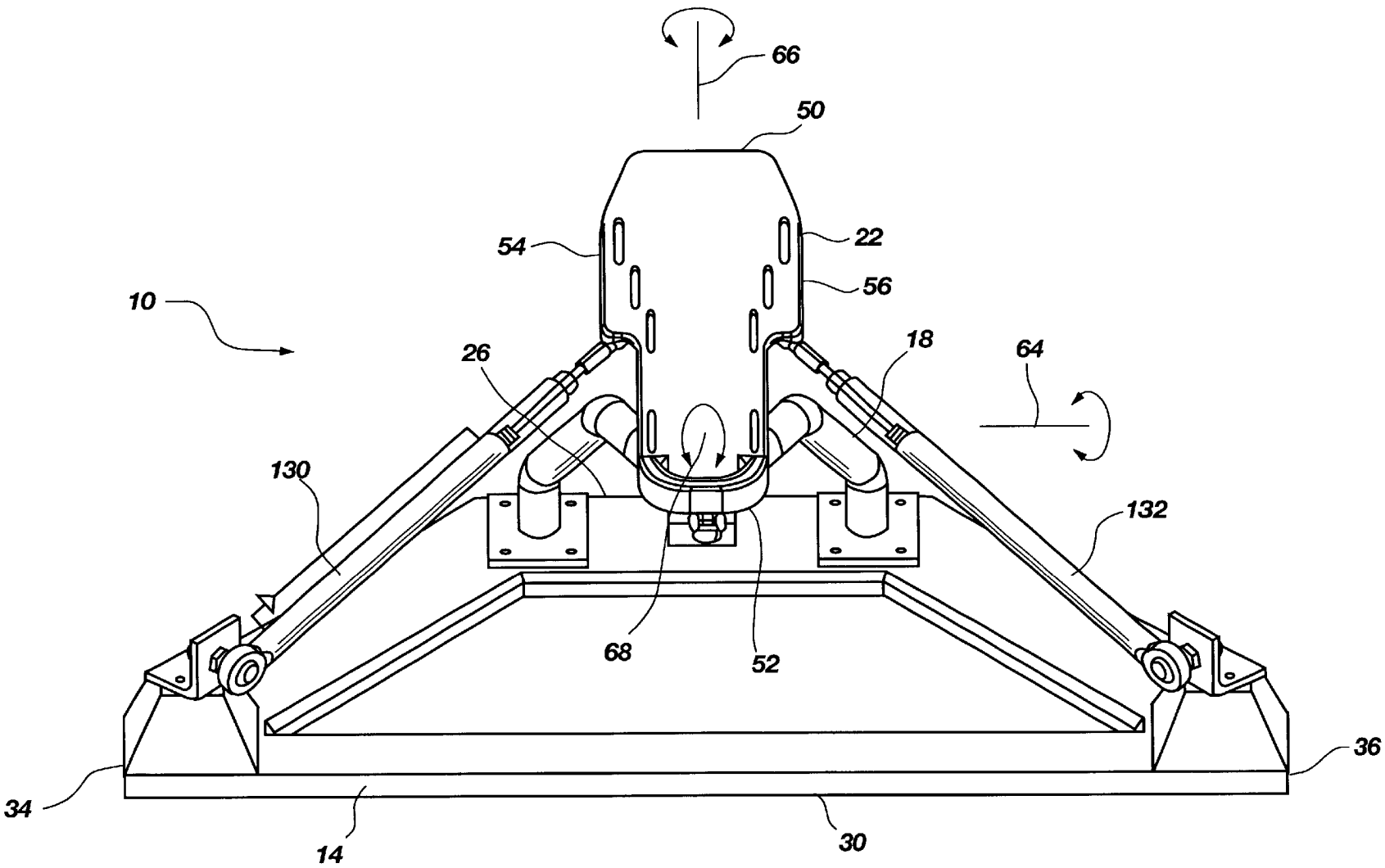
FIG. 3 is another perspective view of the preferred embodiment of the ankle rehabilitation device of the present invention as seen from a user's perspective.

The foot platform 22 has a neutral or initial position, as shown in FIGS. 1–3, in which the foot platform 22 is disposed at an acute, inclined angle with respect to the base 14. Thus, a user may use the device 10 while in a seated position, with the user's lower leg oriented in a natural, inclined angle with respect to the device 10 and the ground. Therefore, the device 10 does not require the user to stand, sit on a special platform, such as a table, or require other support devices for the user, because the user can sit in a typical chair. The heel support 60 helps maintain the user's foot on the foot platform 22 in the inclined orientation so that the user's foot does not slide off.

The foot platform 22, and/or the user's foot/ankle, defines a number of pivot axes about which the foot platform 22 and user's foot pivot. The pivot axes include: (1) a lateral axis 64 (or x-axis) extending left and right, about which the foot platform pivots upwardly and downwardly, and in which the foot pivots in plantar flexion and dorsi flexion; (2) a longitudinal axis 66 (or y-axis) extending forwardly and rearwardly, about which the foot platform pivots or turns inwardly and outwardly, and in which the foot pivots in inversion and eversion; and (3) an orthogonal 68 (or z-axis) extending orthogonally to the foot platform 22 and generally along the user's lower leg, about which the foot platform 22 pivots inwardly and outwardly, and in which the foot pivots in internal and external rotation.

The foot platform 22 is attached to the support arm 18 at an attachment location, indicated generally at 72 in FIG. 2, on the foot platform 22 which generally corresponds to a location under the user's ankle. Thus, the attachment location is located nearer the back 52 of the foot platform 22 than the front 50, and may be located such that the orthogonal axis 68 passes therethrough. Therefore, the foot platform 22 is positioned with respect to the support arm 18 and base 14 to properly position the user's foot and ankle so that the user's ankle is properly pivoted as the foot platform 22 pivots.

Figure 6A:
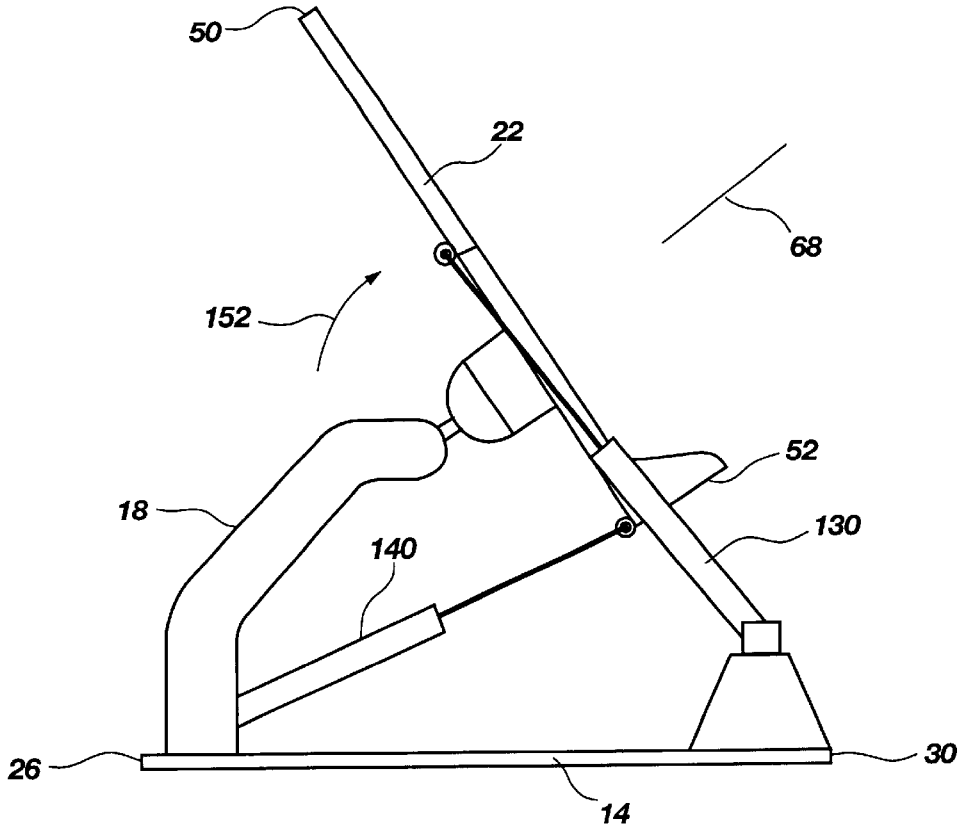
FIG. 6*a* is a side view of the preferred embodiment of the ankle rehabilitation device of the present invention with a foot platform in a retracted position.
Figure 6B:
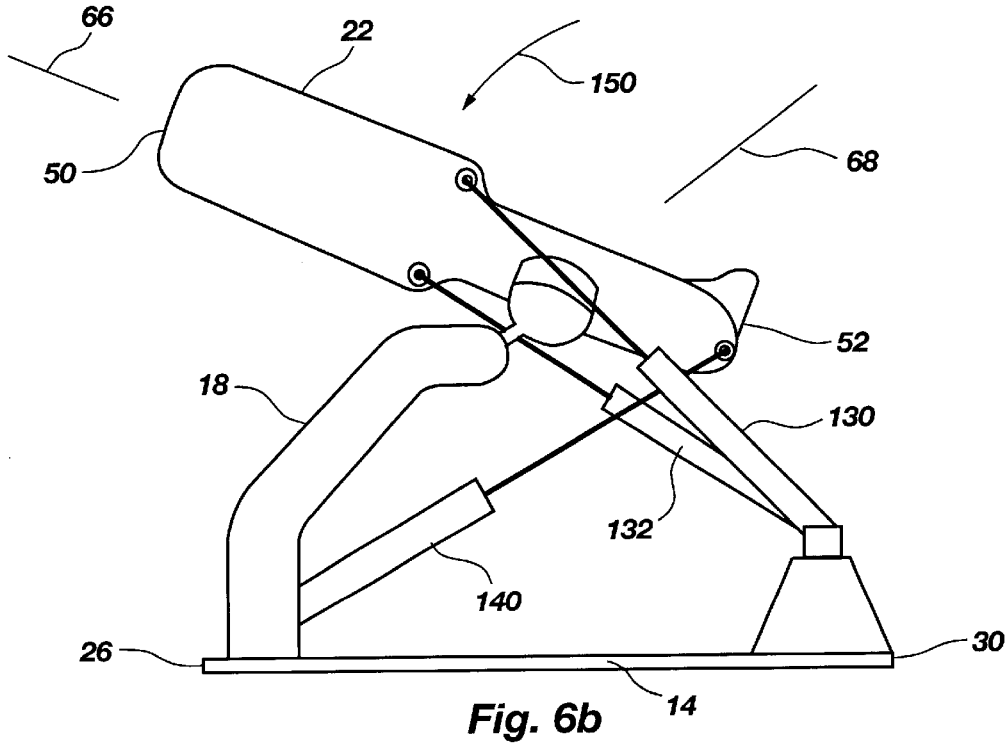
FIG. 6*b* is a side view of the preferred embodiment of the ankle rehabilitation device of the present invention with a foot platform in an extended position.

As indicated above, the foot platform 22 is pivotally attached to the support arm 18 and base 14 to allow the foot platform 22 and the user's foot to pivot as part of exercise or physical therapy. Referring to FIGS. 6*a* and 6*b*, the foot platform 22 preferably pivots along a limited or restricted pivot path to limit the amount and direction of pivot of the user's foot or ankle, thus preventing re-injury. Preferably, the foot platform 22 pivots along the limited pivot path which limits the user's foot to a first extending motion (FIG. 6*b*) including plantar flexion, inversion and internal rotation, and an opposite second retracted motion (FIG. 6*a*) including dorsi flexion, eversion and external rotation. Thus, the user's foot is limited to movement down and in, and then back and out.

Therefore, the foot platform 22 pivots back and forth along the limited pivot path to an extended position (FIG. 6*b*) in which the foot platform 22 is pivoted downwardly about the lateral axis 64, inwardly about the longitudinal axis 66, and inwardly about the orthogonal axis 68. Similarly, the foot platform 22 pivots the opposite direction back along the limited pivot path to a retracted position (FIG. 6*a*) in which the foot platform 22 is pivoted upwardly about the lateral axis 64, outwardly about the longitudinal axis 66, and outwardly about the orthogonal axis 68. The user may repeat this motion to exercise and stretch the ankle. It should be noted that it is the movement of the user's ankle in the retracted direction from the extended position that provides exercise for the injured ligaments of the ankle.

Figure 4:
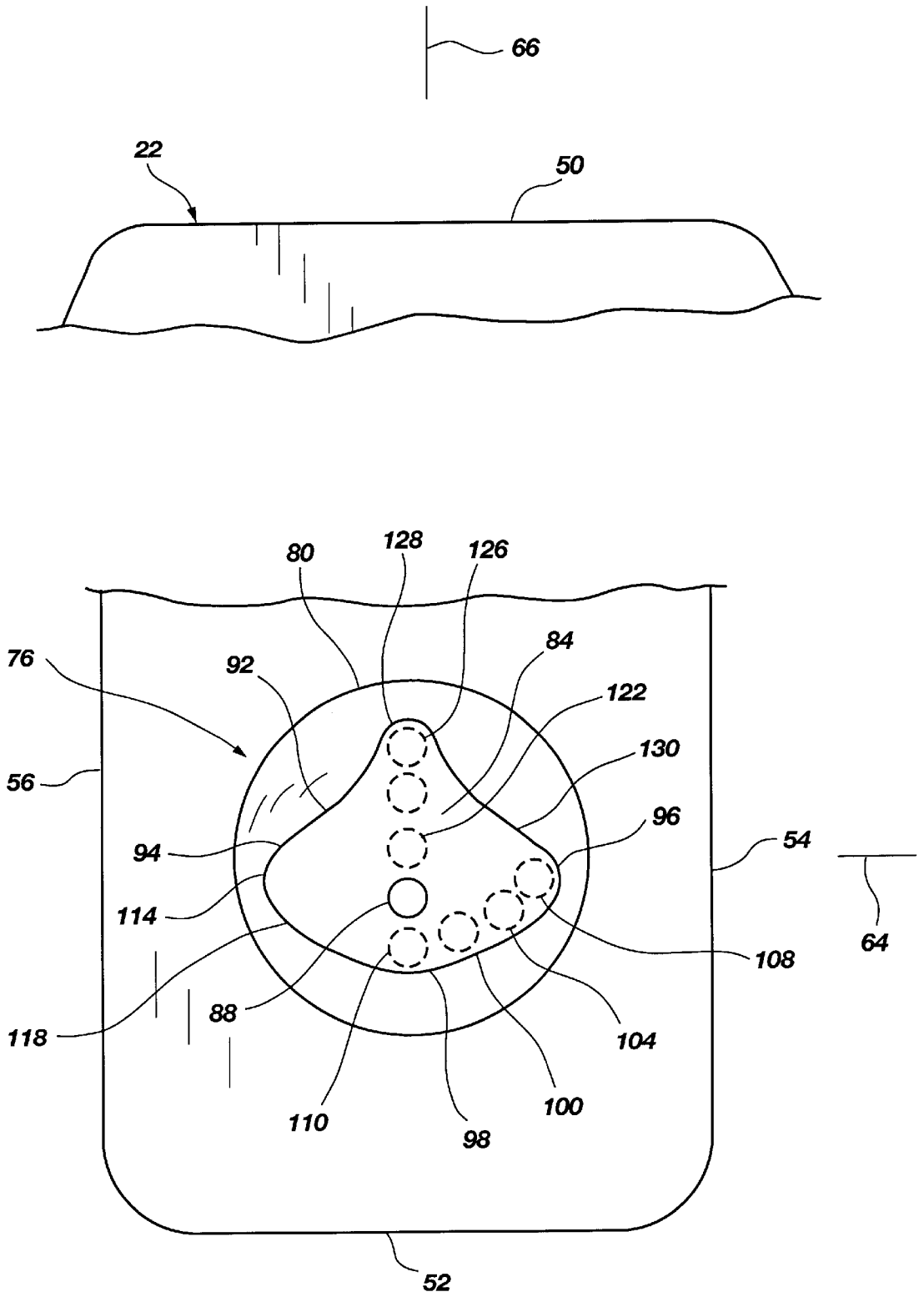
FIG. 4 is a partial cross-sectional view of the preferred embodiment of the ankle rehabilitation device of the present invention.
Figure 5:
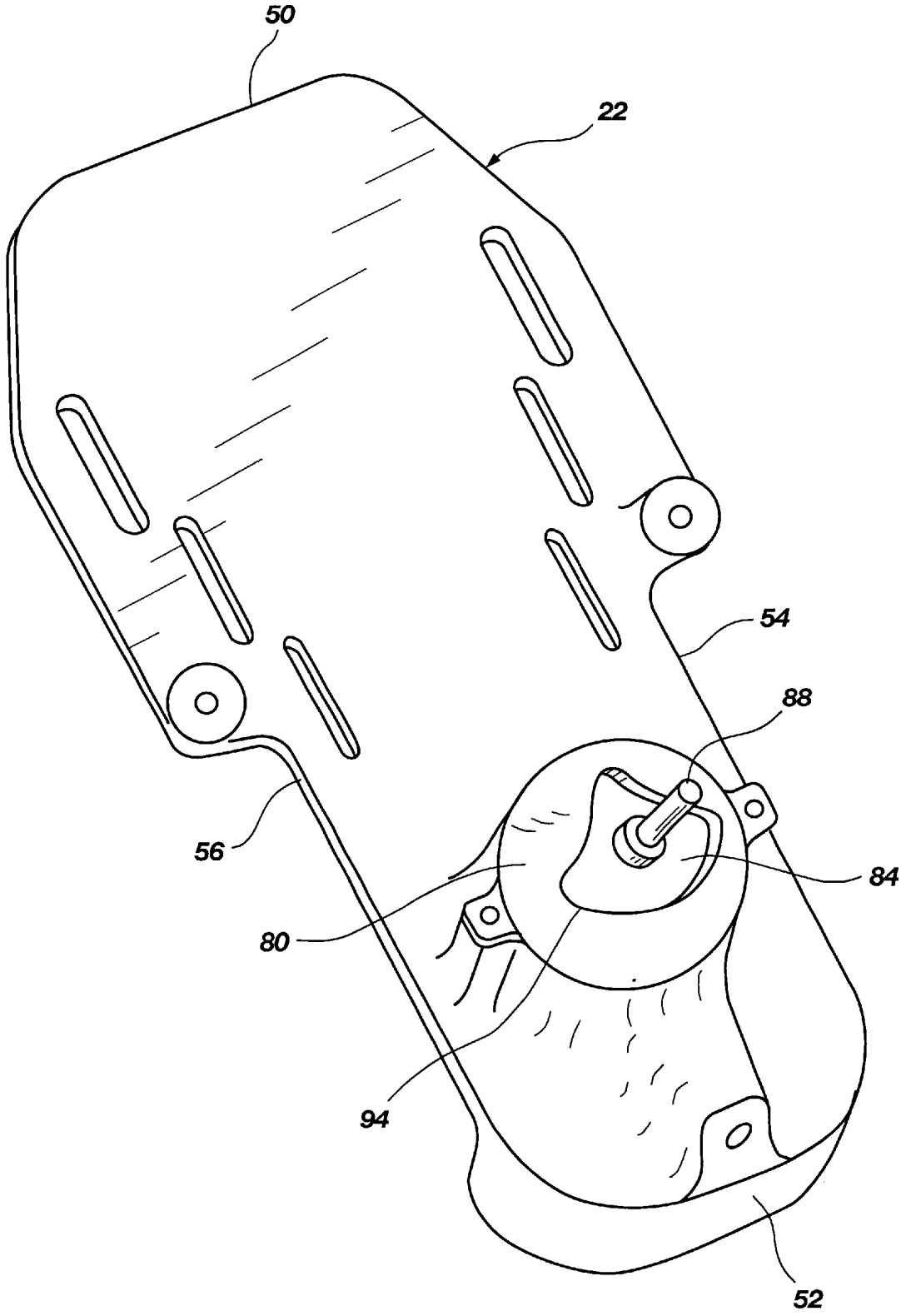
FIG. 5 is a perspective view of a preferred embodiment of a ball-and-socket type joint of the present invention.

Referring to FIGS. 4 and 5, the foot platform 22 is coupled to the support arm 18 by a ball-and-socket type joint 76 to allow for movement about the three axes simultaneously. Preferably, a socket 80 of the joint 76 is formed on a lower surface of the foot platform 22, and a ball 84 of the joint 76 is attached to the support arm 18, and extends into the socket 80. The ball 84 is movably disposed in the socket 80 so that the socket 80 may move about the ball 84 as the foot platform 22 is pivoted. Referring to FIG. 4, the joint 76 has a coupling arm 88 attached to the ball 84 which attaches the ball 84 to the support arm 18. The coupling arm 88 extends through an aperture 92 in the socket 80, and moves in the aperture 92 as the ball 84 and socket 80 pivot with respect to one another.

Advantageously, the aperture 92 in the socket 80 may be sized and shaped to limit movement of the coupling arm 88 within the aperture 92, thus limiting movement of the ball 84 and socket 80, and thus limiting movement of the foot platform 22 with respect to the support arm 18 and base 14. Therefore, the aperture 92 in the socket 80 may be used to restrict movement of the foot platform 22 and the user's foot to prevent re-injury, excessive movement, or improper movement.

The aperture 92 in the socket 80 has a perimeter wall 94 surrounding the aperture 92 which limits movement of the coupling arm 88 in the aperture 92. The aperture 92 preferably has a first concave indentation 96 located towards the front 50 and one of the sides 54 of the foot platform 22, which corresponds to the extended position of the foot platform. The aperture 92 also has a second concave indentation 98 located towards the back 52 of the foot platform 22, which corresponds to the retracted position of the foot platform. A portion 100 of the wall 94 extends between the first and second indentations 96 and 98, which corresponds to the pivot path of the foot platform. The wall portion 100 in the aperture 92 of the socket 80 forms a cam surface against which the coupling arm 88 may abut or slide against as the ball 84 and socket 80 move, or as the foot platform 22 moves.

The pivot path of the coupling arm 88 is represented by a first set of dashed lines, indicated by 104. As the foot platform 22 moves or pivots, the coupling arm 88 moves in the aperture 92, indicated by the dashed lines 104, and may slide or move along the perimeter wall 94 of the aperture 92, or the wall portion 100, with the perimeter wall 94 and wall portion 100 acting as a barrier to limit movement of the coupling arm 88 past the wall portion 100, and thus limit movement of the foot platform 22 away from the desired movement path.

As the foot platform 22 moves between the extended and retracted position, the coupling arm 88 moves within the aperture 92 between respective extended and retracted positions. In the extended position, the coupling arm 88 is located in the first indentation 96 of the aperture 92, indicated at 108. In the retracted position, the coupling arm 88 is located in the second indentation 98 of the aperture 92, indicated at 110. The coupling arm 88 may move or pivot pack and forth between the extended and retracted positions 108 and 110, restricted to the pivot path 104 by the perimeter wall 94 or wall portion 100.

It should be noted that the device 10 of the present invention preferably is designed for use with either of the user's feet. Thus, if the user's right foot is used with the device 10, the movement inwardly will be to the left, as shown and described above. If the user's left foot is used with the device 10, the movement inwardly will be to the right, opposite to that shown and described above. In order to accommodate both of the user's feet, or inward movement to the left or right, the aperture 92 further includes a third concave indentation 114, opposite the first indentation 96, located towards the front 50 and the other side 56 of the foot platform 22, which corresponds to an extended position of the foot platform for the opposite foot. A second wall portion 118 extends between the second and third indentations 98 and 114, which corresponds to a pivot path of the foot platform for the opposite foot.

In addition to performing exercises which include movement down and in, and back up and out, the device 10 may be used to perform simpler movements, such as simple down and up movements, or plantar flexion (FIG. 6*c*) or dorsi flexion (FIG. 6*a*). Thus, the foot platform 22 may have another pivot path in which the coupling arm 88 moves substantially linearly, represented by a second group of dashed lines at 122, between a straight extended location, indicated at 126, and the retracted position 110. Thus, the aperture 92 or perimeter wall 94 may have a fourth concave indentation 128 to receive the post 88 in the straight extended location 126, opposite the second indentation 98. The perimeter wall 94 may form arcuate, convex protrusions 130 extending between the first and fourth indentations 96 and 128, and the third and fourth indentations 114 and 128, to limit movement in undesired directions, and prevent re-injury.

Referring again to FIGS. 1–3, the device 10 also includes one or more piston/cylinders attached to and between the foot platform 22 and the base 14 to resist movement of the platform 22, and thus provide resistance to the user's ankle. The piston cylinders include a rod and piston movably disposed in the cylinder, as is well known. The cylinder contains a working fluid disposed on both sides of the piston. The piston/cylinders may be pneumatic or hydraulic, and the working fluid may be air, oil, water, or the like. Resistance is provided to the foot platform 22, and the user's ankle, by the force required to displace the working fluid as the rod and piston move in the cylinder. In addition, one or more valves may be disposed at inlets and/or outlets to the cylinder to further resist displacement of the working fluid. The valves may be adjustable to vary the amount of resistance. It is of course understood that the displacement of the working fluid may be resisted in other ways, such as by restrictions, an orifice, etc.

Left and right piston/cylinders 130 and 132 extend between respective left and right sides 34 and 36 of the base 14, and respective left and right sides 54 and 56 of the foot platform 22. In addition, the piston/cylinders 130 and 132 preferably extend from the back 30 of the base 14, behind the attachment point 72 of the foot platform 22, to a location on the foot platform 22 forward of the attachment point 72. Thus, the piston/cylinders 130 and 132 extend across the device 10, from the rear 40 of the base 14 forwardly to the foot platform 22, to save space, as opposed to extending between the backs of both the base and the platform, or the fronts of both the base and the platform.

In addition, a third piston/cylinder 140 extends between the front 26 of the base 14, and the back 52 of the foot platform 22. The third piston/cylinder 140 extends from the front 26 of the base 14, forward of the attachment point 72 of the foot platform 22, to the back 52 of the foot platform 22, behind the attachment point 72, to save space. Preferably, the third piston/cylinder 140 is positioned directly under the foot platform 22, and extends from a center of the front 26 of the base 14 to a center or middle of the back 52 of the foot platform 22. Thus, the third piston/cylinder 140 resists the downward and upward movement of the foot platform 22, or planar flexion and dorsiflexion. The wishbone configuration of the support arm 18, with left and right arm portions 40 and 42, allows the third piston/cylinder 140 to extend under the foot platform 22, and the attachment location 72, and to be attached at the center of the front 26 of the base 14.

It should be noted that the piston/cylinders 130, 132 and 140 substantially extend across the device 10, or from one end of the base 10 to near an opposite end of the foot platform 22. Such a configuration reduces the size or footprint of the device, making it more portable. In addition, the left and right piston/cylinders 130 and 132 are oriented transverse to two or all of the pivot axes, or planes defined by the pivot axes. Thus, the left and right piston/cylinders 130 and 132 provide resistance to movement of the foot platform 22 as it pivots about any of the axes. For example, as the foot platform pivots downwardly and upwardly, the piston/cylinders 130 and 132 retract and extend, respectively. As the foot platform 22 tilts inwardly about the longitudinal axis 66, both piston/cylinders 130 and 132 extend, and both retract as the platform tilts back outwardly. As the foot platform 22 pivots inwardly about the orthogonal axis 68, one piston/cylinder retracts while the other extends. Thus, the left and right piston/cylinders 130 and 132 are oriented to resist all pivotal movement. The third piston/cylinder 140 is oriented to provide additional resistance to pivotal movement about the lateral axis 64.

As the piston/cylinders 130, 132 and 140 extend and retract with movement of the foot platform 22, the piston/cylinders move in different planes, or must pivot about their ends. The piston/cylinders are coupled at their ends to the base 14 or foot platform 22 by ball-and-socket type joints. These joints allow the piston/cylinders to pivot about their connections.

To use the device 10, the user places his/her foot, such as the right foot, on the foot platform 22, and secures his/her foot to the platform 22, such as with straps (not shown) passed through the apertures 46. The user may be seated with his/her lower leg at an inclined angle, defining the orthogonal axis 68, and with the foot platform 22 in the neutral position, as shown in FIGS. 1–3. In the most common exercise, the user may then pivot his/her foot and the foot platform 22 back and forth along the restricted movement path, or downwardly and inwardly, indicated by arrow 150 in FIG. 6*b*, and back upwardly and outwardly, indicated by arrow 152 in FIG. 6*a*. Thus, the user pivots his/her foot and the foot platform 22 between the extended position in FIG. 6*b* and the retracted position in FIG. 6*a*. As the user extends his/her foot, the foot platform 22 pivots downwardly about the lateral axis 64, inwardly about the longitudinal axis 66, and inwardly about the orthogonal axis 68, thus providing plantar flexion, inversion and internal rotation. As the user retracts his/her foot, the foot platform 22 pivots in the opposite direction back upwardly about the lateral axis 64, outwardly about the longitudinal axis 66, and outwardly about the orthogonal axis 68, thus providing dorsi flexion, eversion and external rotation. The user may repeat this motion to exercise and stretch the ankle. Again, it is the movement of the user's ankle in the retracted direction from the extended position that provides exercise for the muscles of the ankle. The aperture 94 in the socket 80 limits or restricts the movement of the foot platform 22, and thus the user's foot, to prevent over extension and re-injury.

Figure 6C:
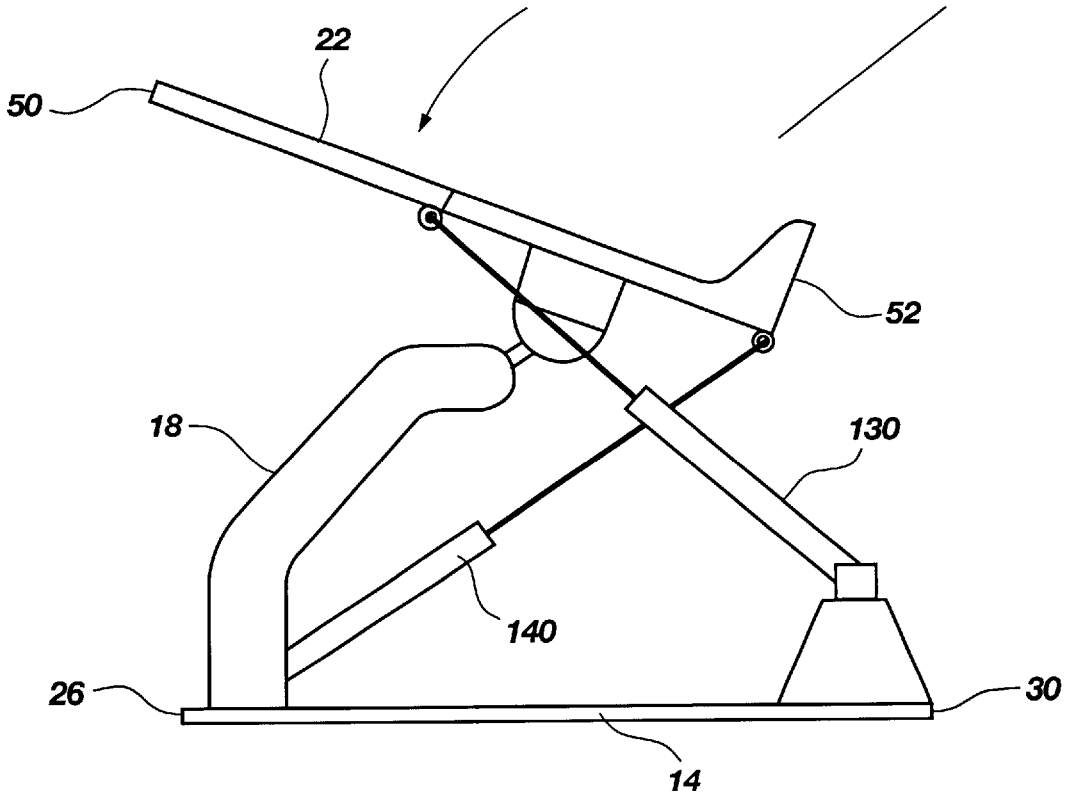
FIG. 6*c* is a side view of the preferred embodiment of the ankle rehabilitation device of the present invention with a foot platform in a straight extended position.

The device 10 may be used for other exercises as well. For example, in a simpler exercise, the user may simply extend his/her foot in a straight fashion, pivoting the foot platform 22 to a straight extended position, as shown in FIG. 6*c*, and retract his/her foot back to the retracted position, as shown in FIG. 6*a*.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An ankle rehabilitation device, comprising:

a) a base;

b) a support arm, coupled to and extending upwardly from the base;

c) a foot platform, pivotally disposed on the support arm, configured to receive a user's foot and pivot along a restricted pivot path configured to limit the user's ankle movement to plantar flexion, inversion and internal rotation in one direction along the restricted pivot path, and dorsi flexion, eversion and external rotation in an opposite direction along the restricted pivot path;

d) resistance means, coupled to and between the base and the foot platform, for resisting movement of the foot platform with respect to the base; and e) a ball and socket type joint, coupled to and between the foot platform and the support arm, to movably couple the foot platform to the support arm, and including a ball movably disposed in a socket, the socket having an aperture and the ball having a coupling arm attached to the ball and extending through the aperture in the socket, the coupling arm being movable in the aperture as the foot platform moves with respect to the base, the aperture having a non-circular shape and an aperture edge which extends into the aperture to limit movement of the coupling arm, and thus to limit movement of the foot platform.

2. The device of claim 1, wherein the foot platform pivots along the restricted pivot path between (i) an extended position in which the foot platform is pivoted down and inwardly, and (ii) a retracted position in which the foot platform is pivoted up and outwardly.

3. The device of claim 1, wherein the aperture has (i) a first concave indentation located towards a side of the foot platform corresponding to an extended position of the foot platform, and (ii) a second concave indentation located towards a rear of the foot platform corresponding to a retracted position of the foot platform.

4. The device of claim 1, wherein the aperture is shaped substantially as shown in FIG. 4.

5. The device of claim 1, wherein the resistance means comprises at least one piston/cylinder, coupled to and extending between the base and the foot platform, oriented transverse to all pivot axes of the foot platform to resist all movement of the foot platform.

6. The device of claim 5, wherein the at least one piston/cylinder is coupled to both the foot platform and base by ball and socket type joints to allow the piston/cylinder to pivot with respect to both the foot platform and base as the foot platform moves.

7. The device of claim 1, wherein the resistance means comprises left and right piston/cylinders, coupled to and extending between respective left and right rear locations of the base rearward of a connection between the foot platform and support arm, and respective left and right sides of the foot platform forward of the connection between the foot platform and support arm.

8. The device of claim 1, wherein the support arm is coupled to the base at a side thereof and extends upwardly to the foot platform at an angle; and wherein the resistance means comprises a piston/cylinder coupled to and between a front of the base forward of a connection between the support arm and foot platform, and a rear of the foot platform.

9. An ankle rehabilitation device, comprising:

a) a base having a front end;

b) a support arm having a first end coupled to the base and extending upwardly to a second end;

c) a foot platform, movably disposed on the second end of the support arm over the base, configured to receive a user's foot and having a rear end; and d) at least one piston/cylinder, coupled to and between the base and the foot platform, to resist movement of the foot platform with respect to the base, and having a first end coupled to the front end of the base and a second end coupled to the rear end of the foot platform to save space.

10. The device of claim 9, wherein the support arm is coupled to the base at a side thereof and extends upwardly to the foot platform at an angle.

11. The device of claim 9, wherein the first end of the piston/cylinder is coupled to the front end of the base forward of a connection between the support arm and foot platform, and the second end of the piston/cylinder is coupled to the rear end of the foot platform rearward of the connection between the support arm and foot platform.

12. The device of claim 9, further comprising:

at least one other piston/cylinder, coupled to and extending between the base and the foot platform, oriented transverse to all pivot axes of the foot platform to resist all movement of the foot platform.

13. The device of claim 12, wherein the other piston/cylinder is coupled to both the foot platform and base by ball and socket type joints to allow the other piston/cylinder to pivot with respect to both the foot platform and base as the foot platform moves.

14. The device of claim 9, further comprising:

left and right piston/cylinders, coupled to and extending between respective left and right rear locations of the base rearward of a connection between the foot platform and support arm, and respective left and right sides of the foot platform forward of the connection between the foot platform and support arm.

15. The device of claim 9, wherein the foot platform is movable along a limited movement path between (i) an extended position which is down, tilted inward and pivoted inward, configured to limit the user's ankle movement to plantar flexion, inversion and internal rotation, and (ii) a retracted position which is up, tilted outward and pivoted outward, configured to limit the user's ankle movement to dorsi flexion, eversion and external rotation.

16. The device of claim 9, further comprising:

a ball and socket type joint, coupled to and between the foot platform and the support arm, to movably couple the foot platform to the support arm, and including a ball movably disposed in a socket, the socket having an aperture and the ball having a coupling arm attached to the ball and extending through the aperture in the socket, the coupling arm being movable in the aperture as the foot platform moves with respect to the base, the aperture being sized and shaped to limit movement of the coupling arm, and thus limit movement of the foot platform.

17. The device of claim 16, wherein the aperture has a non-circular shape and an aperture edge which extends into the aperture to limit movement of the coupling arm.

18. The device of claim 16, wherein the aperture has (i) a first concave indentation located towards a side of the foot platform corresponding to an extended position of the foot platform, and (ii) a second concave indentation located towards a rear of the foot platform corresponding to a retracted position of the foot platform.

19. The device of claim 16, wherein the aperture is shaped substantially as shown in FIG. 4.

20. An ankle rehabilitation device, comprising:

a) a base;

b) a support arm, coupled to and extending upwardly from the base;

c) a foot platform, movably disposed on the support arm, configured to receive a user's foot; and d) at least one piston/cylinder, coupled to and extending between the base and the foot platform, oriented transverse to all pivot axes of the foot platform to resist all movement of the foot platform.

21. The device of claim 20, wherein the at least one piston/cylinder is coupled to both the foot platform and base by ball and socket type joints to allow the piston/cylinder to pivot with respect to both the foot platform and base as the foot platform moves.

22. The device of claim 20, wherein the at least one piston/cylinder includes left and right piston/cylinders, coupled to and extending between respective left and right rear locations of the base rearward of a connection between the foot platform and support arm, and respective left and right sides of the foot platform forward of the connection between the foot platform and support arm.

23. The device of claim 20, wherein the support arm is coupled to the base at a side thereof and extends upwardly to the foot plate at an angle; and wherein the at least one piston/cylinder includes another piston/cylinder coupled to and between a front of the base forward of a connection between the support arm and foot platform, and a rear of the foot platform.

24. The device of claim 20, wherein the foot platform is movable along a limited movement path between (i) an extended position which is down, tilted inward and pivoted inward, configured to limit the user's ankle movement to plantar flexion, inversion and internal rotation, and (ii) a retracted position which is up, tilted outwardly and pivoted outwardly, configured to limit the user's ankle movement to dorsi flexion, eversion and external rotation.

25. The device of claim 20, further comprising:

a ball and socket type joint, coupled to and between the foot platform and the support arm, to movably couple the foot platform to the support arm, and including a ball movably disposed in a socket, the socket having an aperture and the ball having a coupling arm attached to the ball and extending through the aperture in the socket, the coupling arm being movable in the aperture as the foot platform moves with respect to the base, the aperture being sized and shaped to limit movement of the coupling arm, and thus limit movement of the foot platform.

26. The device of claim 25, wherein the aperture has a non-circular shape and an aperture edge which extends into the aperture to limit movement of the coupling arm.

27. The device of claim 25, wherein the aperture has (i) a first concave indentation located towards a side of the foot platform corresponding to an extended position of the foot platform, and (ii) a second concave indentation located towards a rear of the foot platform corresponding to a neutral position of the foot platform.

28. The device of claim 25, wherein the aperture is shaped substantially as shown in FIG. 4.

* * * * *